United States Patent [19]

Yamamoto

[11] Patent Number: 5,015,266

[45] Date of Patent: May 14, 1991

[54] ABRASIVE SHEET AND METHOD FOR MANUFACTURING THE ABRASIVE SHEET

[76] Inventor: Motokazu Yamamoto, 8-20-602, Mita 2-Chome, Minato-Ku, Tokyo, Japan

[21] Appl. No.: 255,113

[22] Filed: Oct. 7, 1988

[30] Foreign Application Priority Data

Dec. 28, 1987 [JP] Japan ..... 62-330404

[51] Int. Cl.[5] ..... B24D 3/00

[52] U.S. Cl. ..... 51/293; 51/295; 51/298

[58] Field of Search ..... 51/293, 295, 298

[56] References Cited

U.S. PATENT DOCUMENTS

| | | | |
|---|---|---|---|
| 2,755,607 | 7/1956 | Haywood | 51/395 |
| 4,078,340 | 3/1978 | Kleeker et al. | 51/295 |
| 4,084,941 | 4/1978 | Cox et al. | 51/295 |
| 4,111,666 | 9/1978 | Kalbow | 51/298 |
| 4,142,334 | 3/1979 | Kirsch et al. | 51/395 |
| 4,162,899 | 7/1979 | Molnar et al. | 51/295 |
| 4,255,164 | 3/1981 | Butzke et al. | 51/295 |
| 4,317,660 | 3/1982 | Kramis et al. | 51/295 |

*Primary Examiner*—William R. Dixon, Jr.
*Assistant Examiner*—Willie Thompson
*Attorney, Agent, or Firm*—Ladas & Parry

[57] ABSTRACT

An abrasive sheet is formed by uniformly painting slurry made of mixture of abrasive particles and adhesives on a surface of a base sheet with a pattern of irregularities by embossing. The slurry layer formed on the sheet hardens by drying at adequate temperature to form an abrasive layer. The abrasive layer has high and low abrasive parts formed by the surface tension of slurry, corresponding to the irregularities of the base sheet. The abrasive sheet is characterized by good planar precision of the abrasive layer, hardness to be peeled off the base sheet, and relatively easy producing method in which grooves are formed by the surface tension.

4 Claims, 5 Drawing Sheets

ABRASIVE SHEET AND METHOD FOR MANUFACTURING THE ABRASIVE SHEET

TECHNICAL FIELD

The present invention relates generally to abrasive sheet and method for manufacturing the abrasive sheet and more particular to the abrasive sheet having its abrasive layer surface with irregularities useful to abrasion for precise finishing surfaces of objects such as machines, apparatuses, parts and so on.

BACKGROUND ART

Where a workpiece is abraded with an abrasive sheet having an even abrasive layer without grooves, scobs from the workpiece get between the abrasive sheet and the abraded surface of the workpiece to disturb abrading it. Also, where abrasive particles fall off the abrasive layer of the abrasive sheet, the particles may flaw on the abraded surface by scratching. In prior art, several techniques have been devised to solve these problems. Amongst the techniques are providing grooves in the abrasive layer to collect scobs from the workpiece and abrasive particles fell off in the grooves to remove them. Prior U.S. Pat. No. 2,755,607 shows a technique which provides grooves in an abrasive layer to comb the abrasive layer. Such a technique, however, makes irregularity on edges of grooves combed, and makes masses of a binding agent to attach them to the teeth of the comb when the abrasive layer is combed by a certain distance. The masses fall off the teeth to attach in places on the surface of the abrasive sheet and make projections on it.

In another technique, various patterns of abrasive layers are made by printing on bases (see U.S. Pat. No. 4,142,334). Such an abrasive sheet has projections which are a pattern being an abrasive layer on a base, and grooves which are except projections. The technique is better for providing grooves, however, is inadequate to abrade and finish a surface of a workpiece to be a precise plane since planar precision of abrasive layers made by printing is not good. Abrasive layers made by printing are also peeled off bases easily.

In another technique, abrasive layers are attached only on tops of projections in bases made of foaming plastics preprovided grooves in (see U.S. Pat. No. 4,111,666). The technique is also better for providing grooves, however, is inadequate to finish a surface of a workpiece to be a precise plane since abrasive layers are not attached evenly on edges of projections.

Furthermore all of above techniques providing grooves have intricate processes of making.

It is accordingly an object of the present invention to provide an abrasive sheet with irregularities with better planar precision of abrasive layers hard to be peeled off bases, said abrasive sheet being made by a relatively simple method.

SUMMARY OF THE INVENTION

In accordance with the present invention, an abrasive sheet is formed by uniformly painting slurry made of mixture of abrasive particles and adhesives or a binder on a surface of a plastic sheet base with a pattern of irregularities by embossing. Thickness of the painted slurry layer is thicker than heights of the base sheet. A surface of the painted slurry is leveled by a roller with a surface finished very precisely. Thus, a slurry layer with good planar precision is formed on the surface of the sheet. The slurry layer hardens by drying at adequate temperature to form an abrasive layer. In the dry hardening process, the slurry painted on the heights of the embossing finished base sheet drys faster than the slurry painted on lows of it to increase the surface tension. The surface tension attracts the around slurry on the lows to raise the slurry on the heights. The slurry painted on the lows of the base sinks by volume of raised slurry to form grooves. As a result, an abrasive layer with irregularities corresponding to heights and lows of a base sheet is formed.

In accordance with the present invention, the resultant abrasive layer has good planar precision in a wide range such as high part and low part being grooves since the painted slurry is leveled by a roller. Abrasive sheets produced by prior printing techniques are peeled off bases easily since the abrasive layer parts are broken by grooves, while the abrasive sheet in accordance with the present invention is hard to be peeled off the base when a workpiece is abraded since high parts and low parts being grooves in the abrasive layer are connected each other.

The abrasive sheet in accordance with the present invention is characterized by good planar precision of the abrasive layer, hardness to be peeled off the base, and relatively easy producing method in which grooves are formed by the surface tension.

The foregoing and additional objects and advantages will become apparent from the following detailed description of the drawing.

DETAILED DESCRIPTION OF THE INVENTION

Figure 1A:
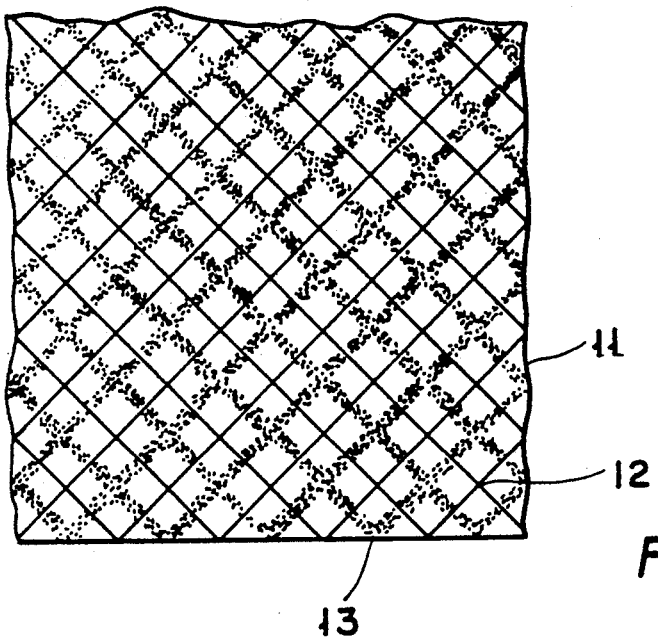
FIG. 1*a* is a plan view of an embodiment of a base sheet produced by embossing finish.
Figure 1B:
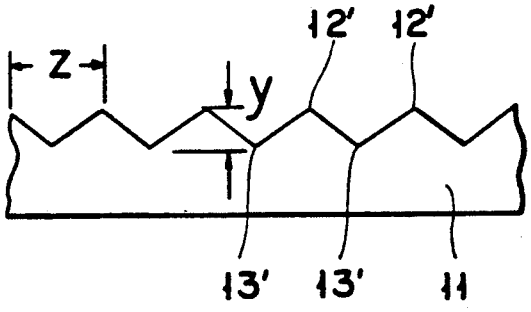
FIG. 1*b* is a front end view of the base sheet in FIG. 1*a*.

FIG. 1*a* is a plan view of an embodiment of a base sheet produced by embossing finish. FIG. 1*b* is a front end view of the base sheet in FIG. 1*a*. A base sheet 11 comprising an abrasive sheet of the present invention is preferably produced by embossing finish, that is heating and compressing a polyester sheet having a thickness between 16 and 100 μm with a mold having irregularities. A surface of base sheet 11 has a irregularities pattern comprising high parts 12 and low parts 13. The irregularities pattern is generally formed on one side of base sheet 11, however, in case of providing the abrasive layer on the both sides of base sheet 11, the irregularities pattern may be formed on the both sides. Embossing of plastic film such as a polyester sheet used as base sheet 11 comprises a process of electric heating or dielectric heating by high frequency electric wave and pressing to form patterns useful for abrading. Space or distance x between tops 12' of adjacent high parts 12 is preferably 1 mm, space or depth y is preferably 0.3 mm.

Figure 2:
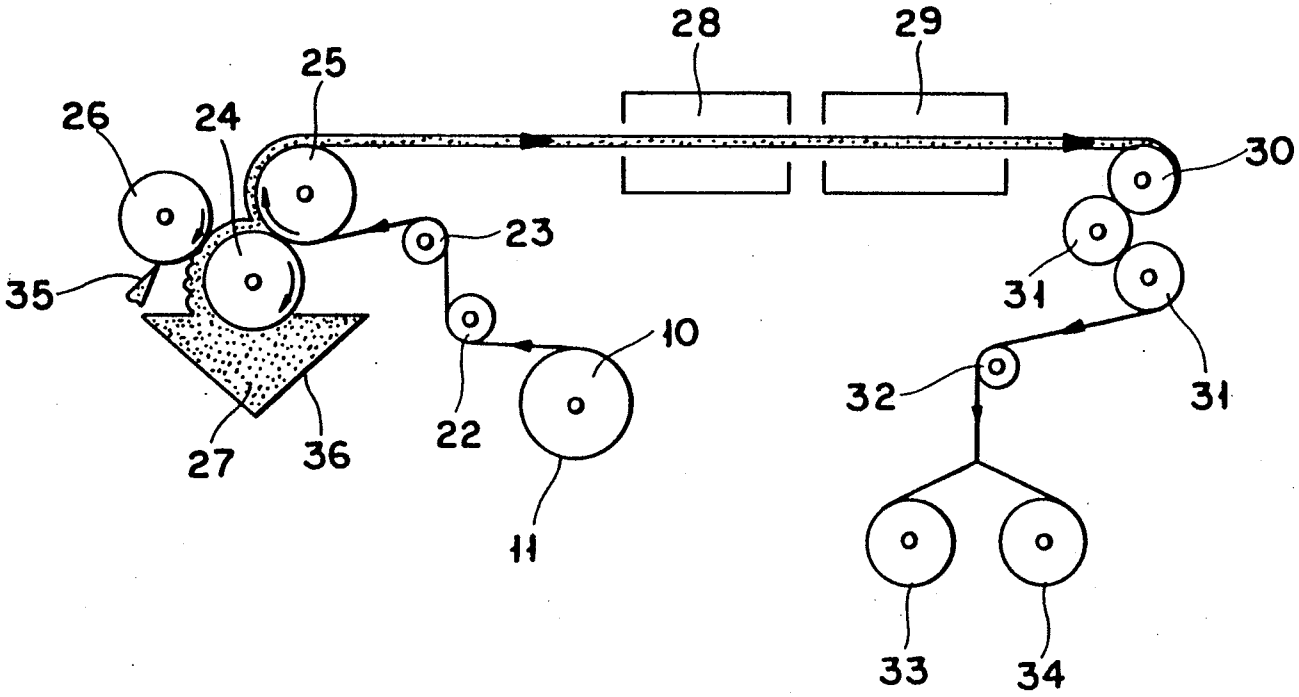
FIG. 2 is a schematic illustration of an apparatus for producing an abrasive sheet in accordance with the present invention.

FIG. 2 is a schematic illustration of an apparatus for producing an abrasive sheet in accordance with the present invention. Base sheet 11 is wound on drum 10 on which high parts 12 and low parts 13 face outside. Base sheet 11 is guided from the drum 10 via guide rollers 22 and 23 between painting rollers 24 and 25 to be painted with slurry 36 by painted roller 24. Thus, the lower of the cylinder surface of painting roller 24 is always contacting on slurry 36 stored in a bath 27. Slurry 30 is mixture of abrasive particles and adhesives acting as binder of the particles.

Abrasive particles are preferably aluminium oxide ($Al_2O_3$), chromium oxide ($Cr_2O_3$), silicon carbide (SiC), iron oxide ($Fe_2O_3$) having their average diameter from 1 to 30 μm.

Resin adhesives or a binder is preferably produced by dissolving saturated polyester resin in solvent mixture of toluene, xylene, ethyl acetate and methyl ethyl ketone and adding isocyanate compound hardener.

Viscocity of slurry being mixture of abrasive particles and adhesives or a binder is from 400 to 600 cp on painting. In order to paint base sheet 11 with slurry 36 evenly, an adjusting roller 26 is spaced by thickness of slurry painted apart from painting roller 24. Therefore, the thickness of slurry 36 painted on base sheet 11 is adjusted, the surface of slurry 36 is leveled precisely, and slurry 36 is painted evenly. Under the adjusting roller 26, doctor blade 35 is provided so that the blade part contacts on the cylinder surface of the adjusting roller 26. Therefore, slurry 36 adhered to the adjusting roller 26 is scraped off into a bath 27.

The base sheet 11 pained with slurry 36 evenly first passes through a low temperature dryer 28, then, passes through a high temperature dryer 29, so that slurry 36 is dryed. It preferably takes two minutes for the base sheet 11 to pass through dryer 28, 29, respectively. Each passing time may be varied within the limits between about 1 and 4 minutes by changing velocity of supplied sheet 11. The temperature in the low temperature dryer 28 preferably ranges from 90° C. to 100° C., while the temperature in the high temperature dryer 29 preferably ranges from 105° C. to 125° C. Base sheet 11 passes through the low temperature dryer 28 before the high temperature dryer 29 in order to prevent surface drying. That is to say, in case of high temperature drying first, the surface of slurry only dries, so that inner solvent molecules cannot evaporate.

Slurry 36 on the base sheet 11 out of the high temperature dryer 29 dries so that an abrasive layer 15 with grooves is formed on the surface of the base sheet 11. The sheet is, thereafter, wound via guide rollers 30, 31, 32 on a bobbin 33 or 34.

Figure 3A:
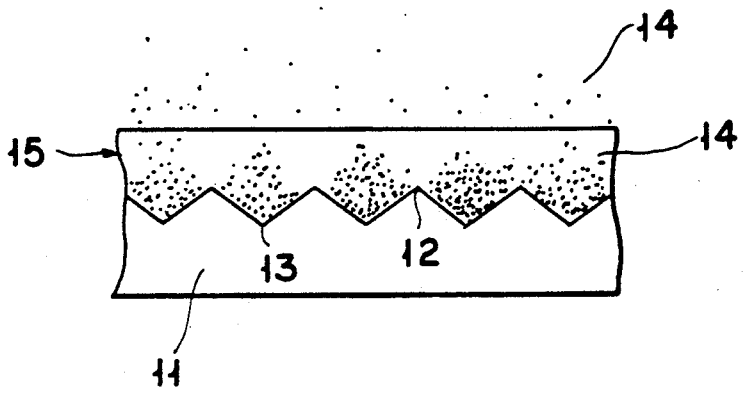
FIG. 3*a* is an end view of a base sheet under low temperature and dry condition, on which slurry is painted evenly.
Figure 3B:
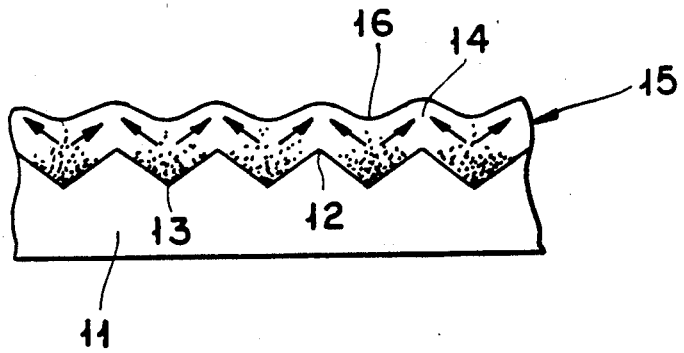
FIG. 3*b* is an end view a base sheet under high temperature and dry condition.
Figure 4A:
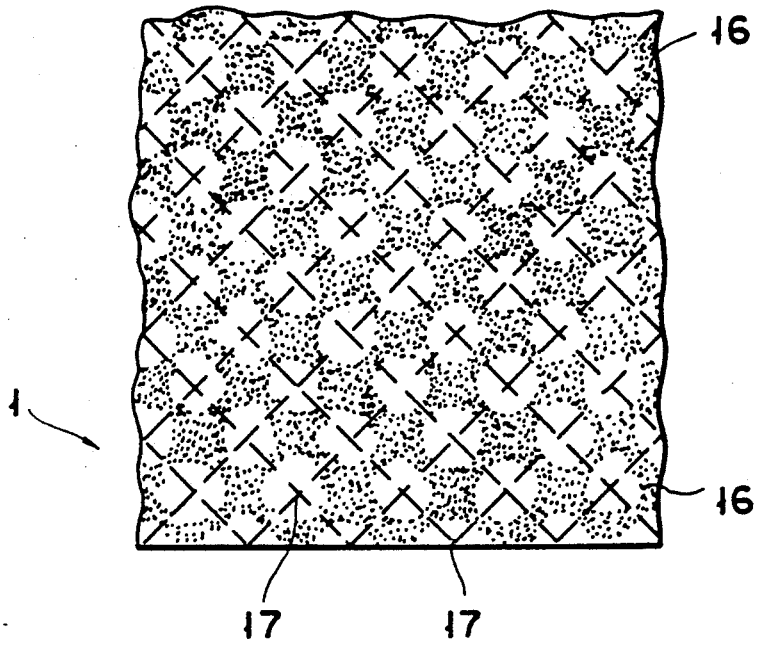
FIG. 4*a* is a plan view of an abrasive sheet with grooves in a base sheet in accordance with the present invention.
Figure 4B:
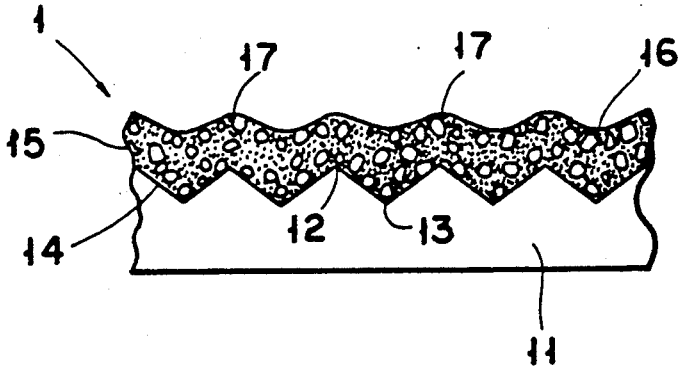
FIG. 4*b* is a front end view of FIG. 4*a*.

FIG. 3*a* is an end view of a base sheet under low temperature and dry condition, on which slurry is painted evenly. FIG. 3*b* is an end view a base sheet under high temperature and dry condition. FIG. 4*a* is a plan view of an abrasive sheet with grooves in a base sheet in accordance with the present invention. FIG. 4*b* is a front end view of FIG. 4*a*. FIG. 3*a* and FIG. 3*b* do not show abrasive particles in slurry or its hardened abrasive layer for simplification, however, FIG. 4*a* and FIG. 4*b* show abrasive particles in the abrasive sheet with grooves in accordance with the present invention.

Figure 5A:
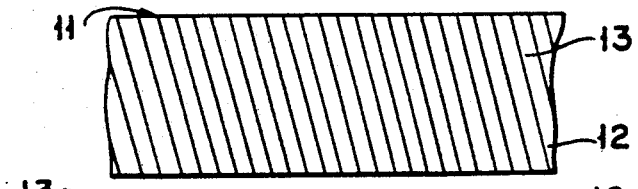
FIGS. 5*a, b, c* show a variety of patterns of a base sheet comprising an abrasive tape.

Referring to FIGS. 3*a*, 3*b* and 4, process of forming grooves on the abrasive layer surface is described hereinafter. With respect to the sheet painted with slurry evenly in the low temperature dryer 28, as shown in FIG. 3*a*, organic solvent molecules 14 (shown by dots) included in adhesives in slurry 36 evaporate to make a difference of the concentration between solvent molecules 14 near the surface of abrasive layer 15 and solvent molecules 14 in the depths near the surface of base sheet 11. Further, the evaporation makes a difference of the concentration between solvent molecules 14 in the abrasive layer 15 painted on high parts 12 in the embossed base sheet 11 and them on low parts 13. Namely, in the abrasive layer 15 on the high parts 12, solvent molecules 14 evaporate to become less since the depth from the surface is small, while on the low parts 13, most of solvent molecules 14 in the depths do not evaporate to remain since the depth from the surface is large. Then, in case the base sheet 11 enters in the high temperature dryer 29, solvent molecules 14 evaporate more and more from the abrasive layer 15, so that slurry on high parts 12, in which solvent molecules 14 have evaporated to become less increases in viscocity and the surface tension of the adhesives becomes more and more higher, as shown in FIG. 3*b*. On the other hand, the viscocity of slurry on low parts 13 is low and the surface tension is low since solvent molecules 14 remains yet. Thus, the tension acts in direction painted out by an arrow in FIG. 3 so that slurry on high parts 12 on the base sheet is raised and slurry on low parts 13 on the base sheet is sunk by the volume moved onto high parts 12. Furthermore, solvent molecules 14 moves from low parts 13 in which the concentration of the molecules 14 is higher to high parts 12 in which the concentration is lower in the same direction as the arrow, so that slurry is raised on high parts 12. As a result, abrasive high parts or raises 17 of the abrasive layer 15 are formed on the base sheet high parts 12 and abrasive low parts or grooves 16 are formed on the low parts 13 corresponding to irregularities of the base sheet 11 as shown in FIG. 4*a* and FIG. 4*b*. Thus, abrasive sheet 1 of the present invention is produced. FIGS. 5*a, b, c* show a variety of patterns of a base sheet comprising an abrasive tape. FIGS. 5*d, e* show patterns of a base sheet comprising a circular abrasive sheet. The patterns of FIGS. 5*d, e* are, in particular, used in case of abrading the workpiece by rotating the abrasive sheet.

Lines 12 in FIGS. 5*a, b, c, d, e* show high parts 12 of base sheet 11.

Figure 5F:
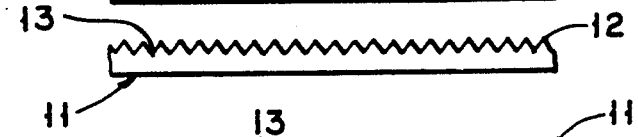
FIGS. 5*f, g, h* show front end view of FIGS. 5*a, b, c*, respectively.
Figure 5B:
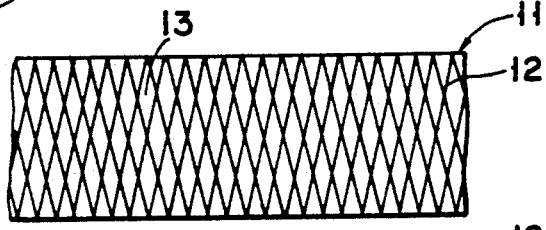
FIGS. 5*d, e* show patterns of a base sheet comprising a circular abrasive sheet.
FIG. 5*i* is an end view of the pattern of the base sheet taken along the line I—I in FIG. 5*d*.
FIG. 5*j* is an end view of the pattern taken along the line II—II in FIG. 5*e*.
FIG. 5*k* is an end view of the pattern taken along the line III—III in FIG. 5*e*.
Figure 5G:
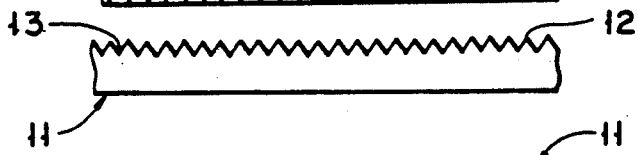
Figure 5C:
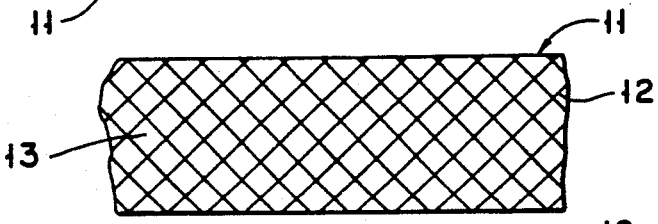
Figure 5H:
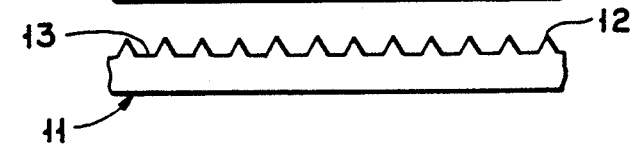
Figure 5D:
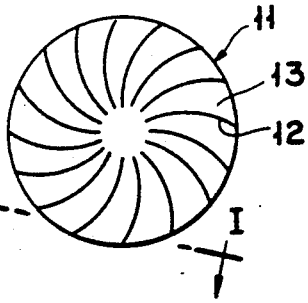

FIGS. 5*f, g, h* show front end view of FIGS. 5*a, b, c*, respectively.

Figure 5E:
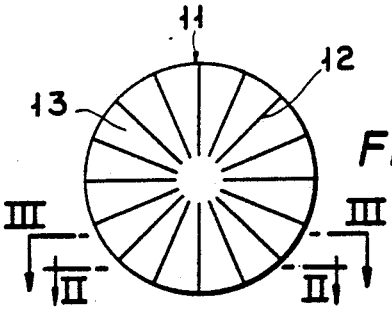
Figure 5I:
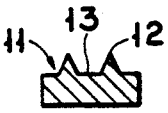

FIG. 5*i* is an end view of the pattern of the base sheet taken along the line I—I in FIG. 5*d*.

Figure 5J:
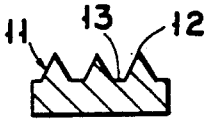

FIG. 5*j* is an end view of the pattern taken along the line II—II in FIG. 5*e*.

Figure 5K:
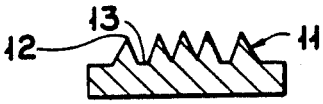

FIG. 5*k* is an end view of the pattern taken along the line III—III in FIG. 5*e*.

As above discussed, an abrasive sheet according to the present invention is useful to finishing abrade precision electronics parts such as magnetic disk, magnetic head and so on since planar precision of abrasive layer is good. Further, abrasive layer hard to be peeled off the base, so that the abrasive sheet can abrade a workpiece with abrasive pressure higher than prior abrasive sheet to increase abrasion efficiency. Furthermore, abrasive sheet according to the present invention is made by a relatively simple method. Volumes of abrasive particles and resin adhesives acting as binder can be decreased by volume of high parts in the embossed base sheet.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A method of making an abrasive sheet comprising the steps of:

embossing at least one side of a base sheet to form irregularities;

painting a slurry, made of a mixture of abrasive particles and resin adhesives, on the embossed side of said base sheet to form an abrasive layer having a substantially planar top surface; and dry hardening said abrasive layer to form high and low abrasive parts corresponding to said irregularities on said side by first passing the slurry painted base sheet through a low temperature dryer to prevent surface drying and then passing the slurry painted base sheet through a high temperature dryer to evaporate organic solvent molecules in the resin adhesives.

2. The method of claim 1 wherein said embossing side of the base sheet is formed by electric or dielectric heating of the base with high frequency electric waves and then molding the base to form a pattern of irregularities on at least one surface of said base sheet.

3. A method of making an abrasive sheet according to claim 1, wherein the resin adhesives are formed by dissolving saturated polyester resin in a solvent mixture of toluene, xylene, ethyl acetate and methyl ethyl ketone and then adding isocyanate compound as a hardener.

4. A method of making an abrasive sheet according to claim 1 wherein the temperature range for the low temperature dryer is from 90° C. to 100° C. and the temperature range for the high temperature dryer is from 105° C. to 125° C.

* * * * *